US010518541B2

(12) United States Patent
Yoshida

(10) Patent No.: US 10,518,541 B2
(45) Date of Patent: Dec. 31, 2019

(54) LIQUID EJECTING APPARATUS AND MAINTENANCE METHOD FOR THE SAME

(71) Applicant: SEIKO EPSON CORPORATION, Tokyo (JP)

(72) Inventor: Takeshi Yoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/177,073

(22) Filed: Oct. 31, 2018

(65) Prior Publication Data

US 2019/0126624 A1 May 2, 2019

(30) Foreign Application Priority Data

Nov. 2, 2017 (JP) ..... 2017-212824

(51) Int. Cl.
*B41J 2/165* (2006.01)

(52) U.S. Cl.
CPC ..... *B41J 2/16552* (2013.01); *B41J 2/16505* (2013.01); *B41J 2/16508* (2013.01); *B41J 2/16517* (2013.01); *B41J 2/16523* (2013.01); *B41J 2/16526* (2013.01); *B41J 2/16535* (2013.01); *B41J 2/16538* (2013.01)

(58) Field of Classification Search
CPC ..... B41J 2/16505; B41J 2/16508; B41J 2/16517; B41J 2/16523; B41J 2/16526; B41J 2/16535; B41J 2/16538; B41J 2/16552
See application file for complete search history.

(56) References Cited

U.S. PATENT DOCUMENTS

2010/0231634 A1* 9/2010 Yokota ..... B41J 2/16538 347/17
2017/0203573 A1* 7/2017 Hiramoto ..... B41J 2/16508

FOREIGN PATENT DOCUMENTS

| | | | |
|---|---|---|---|
| JP | 09-30004 | A | 2/1997 |
| JP | 11-268294 | A | 10/1999 |
| JP | 2001-18408 | A | 1/2001 |
| JP | 2001-253081 | A | 9/2001 |
| JP | 2003-320674 | A | 11/2003 |
| JP | 2007-105599 | A | 4/2007 |
| JP | 2008-238561 | A | 10/2008 |
| JP | 2009-226719 | A | 10/2009 |
| JP | 2010-162791 | A | 7/2010 |
| JP | 2012-158072 | A | 8/2012 |

* cited by examiner

*Primary Examiner* — Anh T Vo
(74) *Attorney, Agent, or Firm* — Workman Nydegger

(57) ABSTRACT

A liquid ejecting apparatus includes a liquid ejecting head having a nozzle that ejects liquid to an ejection medium; a maintenance mechanism having a receiving portion that receives the liquid which is discharged from the liquid ejecting head in a maintenance operation for the liquid ejecting head; and a cleaning liquid supply mechanism configured to supply cleaning liquid to the receiving portion in a cleaning operation of cleaning the receiving portion. If a time from when the maintenance operation of former one has been executed to when the maintenance operation of later one is executed is equal to or longer than a first setting time and shorter than a second setting time, after the maintenance operation of the later one is executed, the cleaning operation is executed subsequently to the maintenance operation of the later one.

9 Claims, 11 Drawing Sheets

LIQUID EJECTING APPARATUS AND MAINTENANCE METHOD FOR THE SAME

BACKGROUND

1. Technical Field

The present invention relates to a liquid ejecting apparatus such as an ink jet printer, and a maintenance method for the liquid ejecting apparatus.

2. Related Art

An example of a liquid ejecting apparatus may be an ink jet recording apparatus that draws a character or a diagram on a recording medium (ejection medium) by ejecting ink (liquid) from nozzles formed at a print head (liquid ejecting head). The recording apparatus includes a cap (receiving portion) that covers the periphery of the nozzles, or a wiper that wipes a nozzle surface in which the nozzles are formed, as an example of a maintenance mechanism that performs maintenance for the print head (for example, JP-A-2001-253081).

Such recording apparatuses may include a cleaning head (cleaning liquid supply mechanism) that cleans the wiper by ejecting cleaning liquid toward the wiper. The cleaning head ejects the cleaning liquid also into the cap, and thus, the space around the nozzles covered with the cap is maintained in a high-humidity atmosphere with the cleaning liquid.

The recording apparatus uses the cleaning liquid for cleaning the wiper and moisturizing the inside of the cap. However, there is still room for improvement in the method of using the cleaning liquid.

The issue is not applied to only the recording apparatus including the cleaning head, but is mostly common to liquid ejecting apparatuses including cleaning liquid supply mechanisms.

SUMMARY

An advantage of some aspects of the invention is to provide a liquid ejecting apparatus capable of efficiently cleaning a maintenance mechanism while ensuring maintenance performance for a liquid ejecting head by the maintenance mechanism, and also provide a maintenance method for the liquid ejecting apparatus.

A measure for addressing the issue is described below.

According to an aspect of the invention, a liquid ejecting apparatus includes a liquid ejecting head having a nozzle that ejects liquid to an ejection medium; a maintenance mechanism having a receiving portion that receives the liquid which is discharged from the liquid ejecting head in a maintenance operation for the liquid ejecting head; a cleaning liquid supply mechanism configured to supply cleaning liquid to the receiving portion in a cleaning operation of cleaning the receiving portion; and a controller. If a time from when the maintenance operation of former one has been executed to when the maintenance operation of later one is executed is equal to or longer than a first setting time and shorter than a second setting time, the controller executes, after the maintenance operation of the later one is executed, the cleaning operation subsequently to the maintenance operation of the later one.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of a liquid ejecting apparatus and a maintenance method for the liquid ejecting apparatus are described below with reference to the drawings. The liquid ejecting apparatus is, for example, an ink jet printer that performs recording (printing) by ejecting ink, which is an example of liquid, onto an ejection medium such as a sheet of paper.

Figure 1:
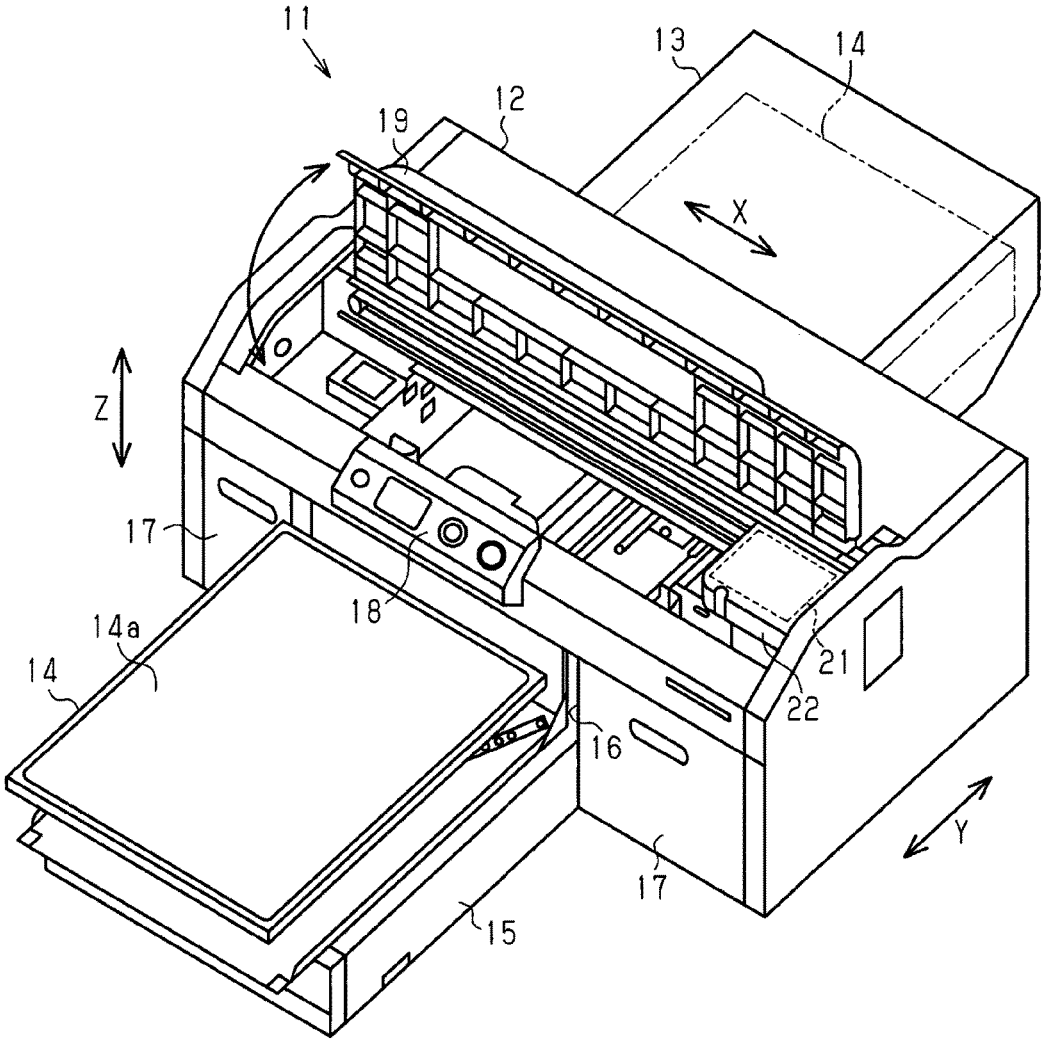
FIG. 1 is a perspective view of an embodiment of a liquid ejecting apparatus.

As illustrated in FIG. 1, a liquid ejecting apparatus 11 includes substantially rectangular box-shaped first housing 12 and second housing 13. In this embodiment, the side provided with the first housing 12 is referred to as front side and the side provided with the second housing 13 is referred to as rear side for the liquid ejecting apparatus 11. The direction which intersects with (in this embodiment, orthogonal to) an up/down direction Z along the vertical direction and in which the first housing 12 and the second housing 13 are arranged is illustrated as front/rear direction Y. The direction which intersects with (in this embodiment, orthogonal to) the up/down direction Z and the front/rear direction Y and which is along the longitudinal direction of the first housing 12 is illustrated as width direction X.

A medium transport section 15 is fixed to the first housing 12 in a manner protruding forward from the first housing 12. The medium transport section 15 supports a medium support tray 14 so as to transport the medium support tray 14 in the front/rear direction Y. An opening 16 is formed in the front surface of the first housing 12. The opening 16 allows the movement of the medium support tray 14 in the front/rear direction Y. A space (not shown) that allows the movement of the medium support tray 14 is formed in the first housing 12 and the second housing 13 so as to extend from the first housing 12 to the second housing 13. In the following description, the space formed to extend from the first housing 12 to the second housing 13, and the opening formed in the front surface of the first housing 12 are collectively referred to as opening 16.

The upper surface of the medium support tray 14 serves as a set surface 14*a* on which an ejection medium S (see FIG. 3) can be set. The medium support tray 14 is movable between a medium set position indicated by solid lines in FIG. 1, and a print start position indicated by two-dot chain lines in FIG. 1. The medium set position is a position at which the medium support tray 14 is exposed from the first housing 12, and at which the ejection medium S can be set on the set surface 14*a*. The medium support tray 14 reciprocates in the front/rear direction Y between the medium set position and the print start position with driving of a transport motor (not shown).

An opening/closing cover 17 is rotatably attached to the front surface of the first housing 12, at a position on each of both sides of the opening 16 in the width direction X. The opening/closing cover 17 is arranged at a closed position shown in FIG. 1, and an open position at which an upper end portion thereof swings forward and downward and the inside of the first housing 12 is exposed, by rotating the opening/closing cover 17 such that the upper end thereof swings around a rotating shaft (not shown) provided at the lower end thereof.

An operation panel 18 is attached above the opening 16. The operation panel 18 displays the operating state of each component included in the liquid ejecting apparatus 11, and receives an input instruction. An upper cover 19 is provided rotatably on the rear side of the operation panel 18. The upper cover 19 is arranged at an open position shown in FIG. 1, and a closed position at which the distal end thereof swings forward and downward from the open position and the contents in the first housing 12 are hidden, by rotating the upper cover 19 around a rotating shaft (not shown) provided on the proximal end thereof.

The liquid ejecting apparatus 11 includes a liquid ejecting head 21 that ejects liquid, and a holder 22 that holds the liquid ejecting head 21. The holder 22 in this embodiment is a carriage that holds a liquid ejecting head 21 of serial type and reciprocates across the ejection medium S. Alternatively, the holder 22 may arrange a liquid ejecting head 21 of line head type by fixing the liquid ejecting head 21 in a transport path for the ejection medium S.

Figure 2:
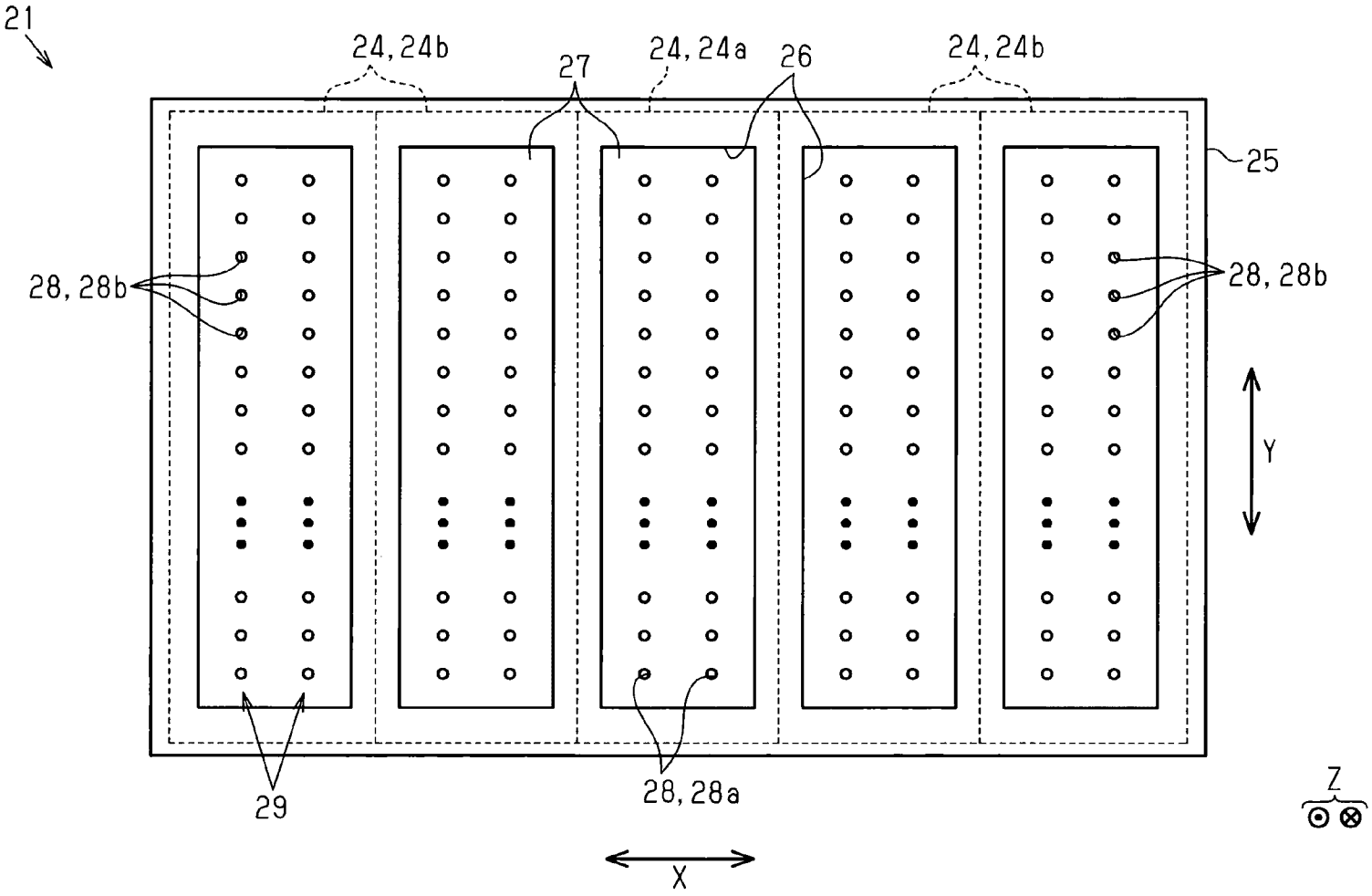
FIG. 2 is a schematic bottom view of a liquid ejecting head included in the liquid ejecting apparatus in FIG. 1.

As shown in FIG. 2, the liquid ejecting head 21 has a plurality of (in this embodiment, five) head units 24 arranged in the width direction X. In this embodiment, one center head unit 24 among the five head units 24 is a cleaning liquid head unit 24*a* that ejects cleaning liquid. The other four head units 24 are liquid head units 24*b* that eject liquid such as ink. The cleaning liquid head unit 24*a* and the liquid head units 24*b* have the same configuration.

The plurality of head units 24 are covered with a metal sheet 25 from below and held by the metal sheet 25 that is bent upward and extends in the width direction X and the front/rear direction Y. The metal sheet 25 has the same number of through holes 26 as the number of head units 24. The lower surfaces of the head units 24 exposed from the rectangular through holes 26 serve as nozzle formation surfaces 27. The nozzle formation surfaces 27 each have multiple nozzles 28 formed therein.

The liquid ejecting head 21 has cleaning liquid nozzles 28*a* that supply the cleaning liquid, and liquid nozzles 28*b* which are an example of a nozzle that ejects the liquid onto the ejection medium S. That is, the nozzles 28 formed in the nozzle formation surface 27 of the cleaning liquid head unit 24*a* serve as the cleaning liquid nozzles 28*a*. The nozzles 28 formed in the nozzle formation surface 27 of the liquid head unit 24*b* serve as the liquid nozzles 28*b*.

The multiple (for example, 180 or 360) nozzles 28 are arranged with a constant pitch in the front/rear direction Y, and serve as a nozzle row 29. One head unit 24 has at least one nozzle row 29 (in this embodiment, two nozzle rows 29). The head units 24 eject different kinds of liquid on the head unit 24 basis. In other words, the plurality of nozzle rows 29 included in one head unit 24 eject the same kind of liquid. The plurality of nozzles 28 are provided for one kind of liquid.

Figure 3:
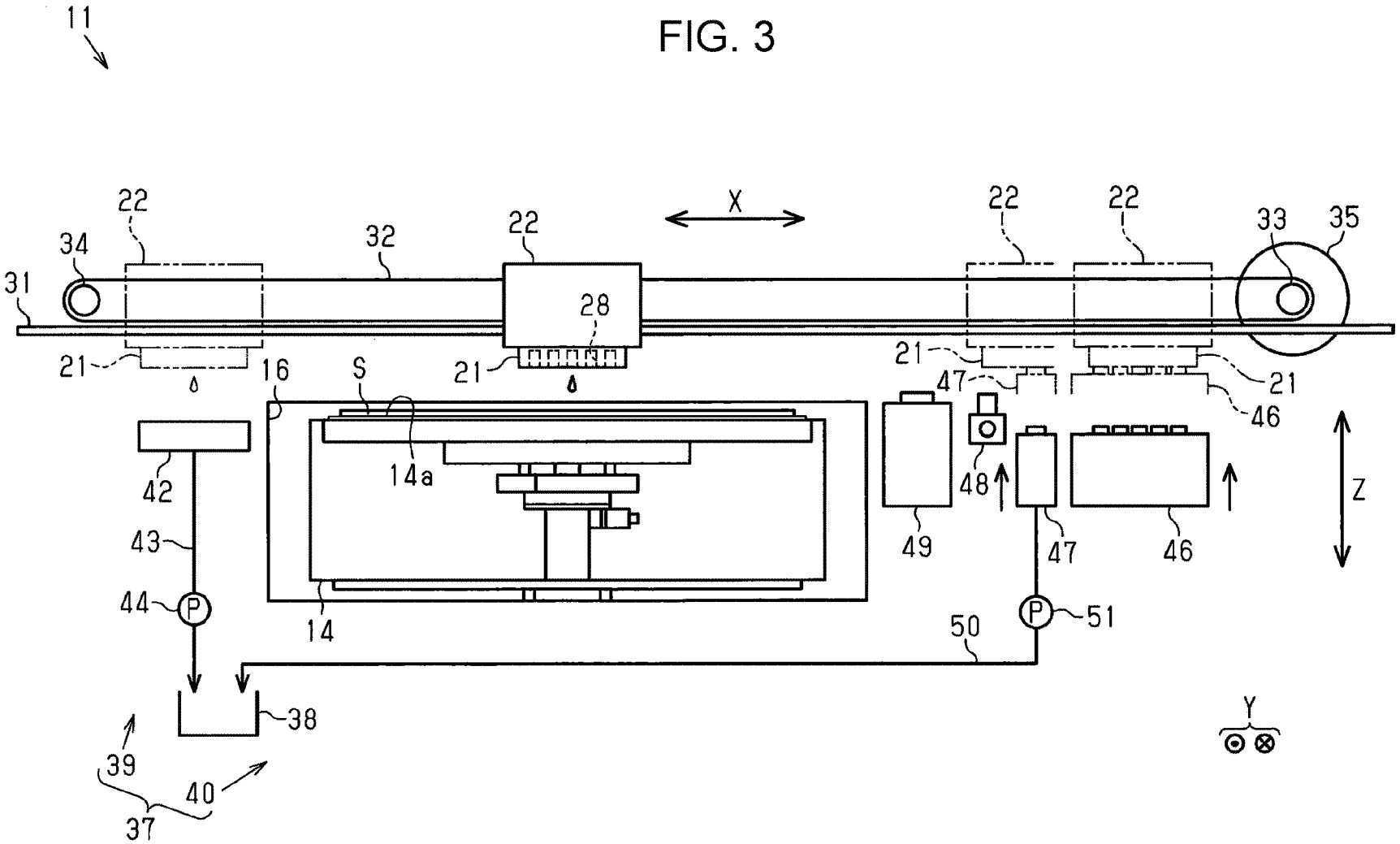
FIG. 3 is a schematic front view showing the inner configuration of a first housing included in the liquid ejecting apparatus in FIG. 1.

As shown in FIG. 3, a guide shaft 31 that extends in the width direction X is provided in the first housing 12. The guide shaft 31 supports the holder 22 so as to reciprocate in the width direction X, which is an example of a main-scanning direction. Further, a driving pulley 33 and a driven pulley 34 are rotatably supported in the first housing 12. A timing belt 32 part of which is fixed to the holder 22 is wound around the driving pulley 33 and the driven pulley 34. The driving pulley 33 is coupled to a carriage motor 35. When the timing belt 32 rotates by driving of the carriage motor 35, the holder 22 and the liquid ejecting head 21 reciprocate in the width direction X.

The liquid ejecting apparatus 11 includes a maintenance mechanism 37 for performing maintenance for the liquid ejecting head 21, and a waste liquid container 38 that stores waste liquid which is discharged from the liquid ejecting head 21 due to the maintenance. The maintenance mechanism 37 performs maintenance for the liquid ejecting head 21 to prevent or address an ejection failure caused by clogging of the nozzles 28, mixing of air bubbles into the liquid ejecting head 21, or adhesion of abnormal substances to the periphery of the nozzles 28.

The maintenance mechanism 37 includes a flushing unit 39 provided on one side in the width direction X and a maintenance unit 40 provided on the other side in the width direction X with the opening 16 arranged therebetween. The flushing unit 39 and the maintenance unit 40 are provided at positions shifted from the position of the opening 16 in the width direction X so as not to interfere with the medium support tray 14 that moves in the front/rear direction Y. The position at which the maintenance unit 40 is provided is a home position.

The flushing unit 39 receives the liquid ejected from the liquid ejecting head 21 by flushing. Flushing is an operation of discharging the liquid from the nozzles 28, and hence discharging abnormal substances, air bubbles, or degraded liquid (for example, ink with viscosity increased) which may cause an ejection failure. Flushing is executed to address a slight ejection failure.

The flushing unit 39 includes a flushing box 42, a flushing tube 43 connected to the flushing box 42, and a flushing pump 44 configured to suck the inside of the flushing box 42. The upstream end of the flushing tube 43 is connected to the flushing box 42, and the downstream end thereof is connected to the waste liquid container 38. The flushing pump 44 is provided at an intermediate position of the flushing tube 43. The flushing pump 44 may be, for example, a tube pump. Alternatively, any of other types of pumps may be used.

The maintenance unit 40 includes a moisturizing cap 46, a suction cap 47 serving as an example of a receiving portion and a cap, a wiper 48, and an absorbing member 49. The maintenance unit 40 includes a suction tube 50 serving as a discharge channel that connects the suction cap 47 with the waste liquid container 38, and a suction pump 51 configured to suck the inside of the suction cap 47. The suction pump 51 is provided at an intermediate position of the suction tube 50. The suction pump 51 may be, for example, a tube pump. Alternatively, any of other types of pumps may be used.

At least one of a set of the moisturizing cap 46 and the suction cap 47, and the liquid ejecting head 21 is configured to relatively move between a capping position at which the space where the nozzles 28 are open is a closed space, and a retraction position at which the space where the nozzles 28 are open is an open space. The moisturizing cap 46, the suction cap 47, and the liquid ejecting head 21 are arranged at the capping position, and hence capping is provided.

The moisturizing cap 46 forms a closed space where all the nozzles 28 are covered at once. The moisturizing cap 46 provides capping when the liquid is not ejected. By preventing drying of the nozzles 28, occurrence of an ejection failure is prevented. The moisturizing cap 46 is used to prevent evaporation of ink in each nozzle 28 of the liquid ejecting head 21 when printing is suspended or when the apparatus is not used.

The suction cap 47 contacts the liquid ejecting head 21 and forms a space containing the nozzles 28. The suction cap 47 forms a closed space that covers the nozzles 28 of one head unit 24. The suction cap 47, the suction tube 50, and the suction pump 51 perform a maintenance operation for the liquid ejecting head 21, and a cleaning operation of cleaning the suction cap 47 and the suction tube 50. The maintenance operation in this embodiment is suction cleaning of sucking and discharging the liquid from the liquid nozzles 28*b*.

The maintenance operation and the cleaning operation are performed by causing a negative pressure which is generated by driving of the suction pump 51 to act on the closed space formed by arranging the suction cap 47 at the capping position. When a negative pressure acts on the liquid ejecting head 21, fluid is sucked and discharged from the nozzles 28. That is, in the maintenance operation, the suction pump 51 applies a negative pressure to the liquid ejecting head 21 and causes the liquid in the liquid ejecting head 21 to be discharged to the outside. In the cleaning operation, the suction pump 51 applies a negative pressure to the liquid ejecting head 21 and causes the cleaning liquid in the liquid ejecting head 21 to be discharged to the outside. In this embodiment, ejection of the cleaning liquid from the cleaning liquid nozzles 28*a*, suction of the cleaning liquid by the suction pump 51, and supply with the cleaning liquid to the suction cap 47 can be performed.

The wiper 48 wipes the nozzle formation surface 27 by contacting the nozzle formation surface 27 while being elastically deformed. The absorbing member 49 absorbs the ink adhering to the nozzle formation surface 27 by contacting the nozzle formation surface 27.

The flushing unit 39 and the maintenance unit 40 may be detachably attached to the first housing 12, and may be replaceable. The flushing unit 39 and the maintenance unit 40 are accessible by displacing the upper cover 19 to an open position shown in FIG. 1. Thus, the maintenance and replacement for the flushing unit 39 and the maintenance unit 40 can be easily performed.

Figure 4:
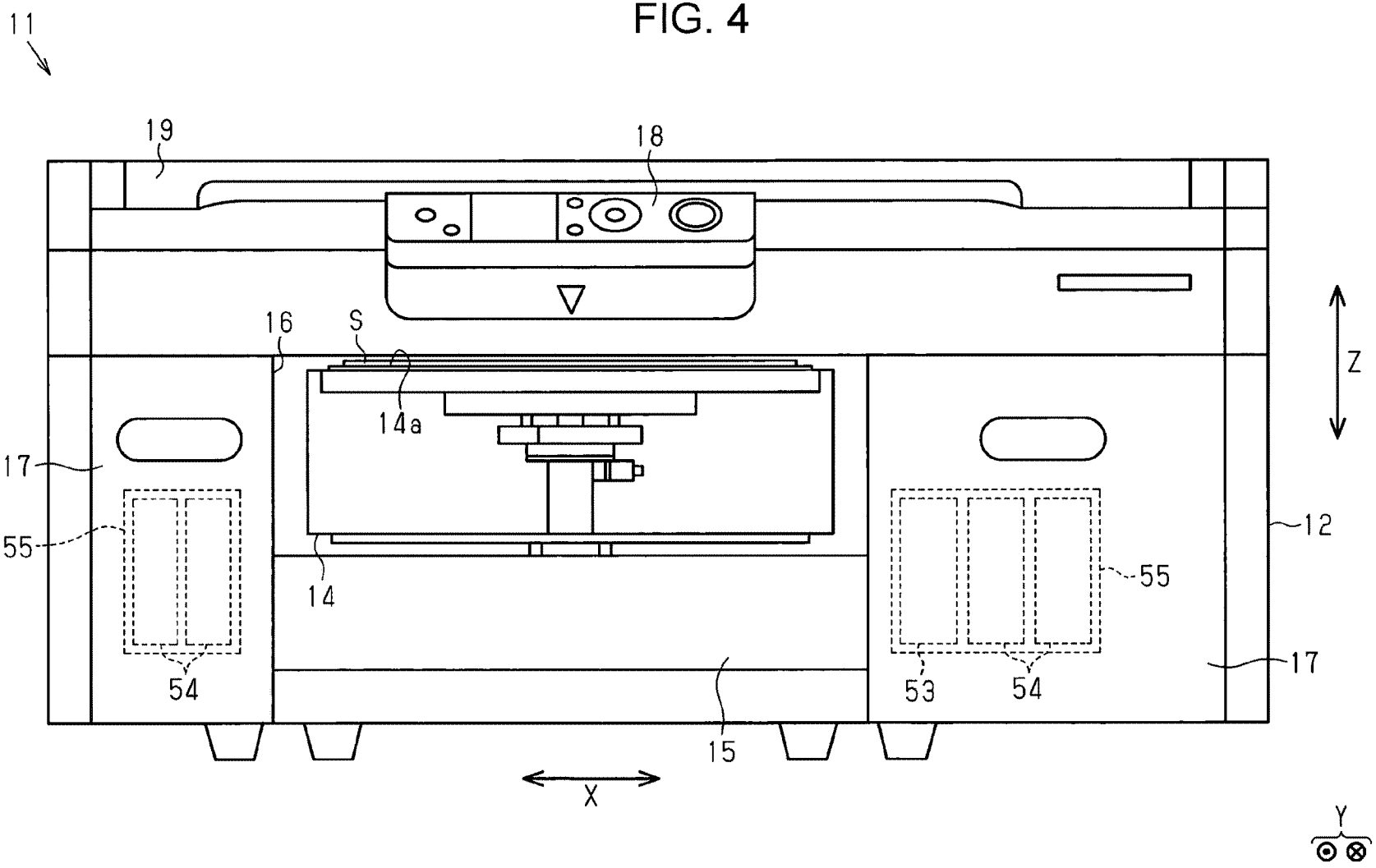
FIG. 4 is a front view of the liquid ejecting apparatus in FIG. 1.

As shown in FIG. 4, the liquid ejecting apparatus 11 includes an attachment portion 55 to which a cleaning liquid supply source 53 that stores the cleaning liquid, and a liquid supply source 54 that stores the liquid such as ink are detachably attached. The attachment portion 55 may be provided on each of both sides in the width direction X in the first housing 12 such that the opening 16 is arranged therebetween. The cleaning liquid supply source 53 and the liquid supply source 54 attached to the attachment portion 55 appear and are replaceable when the opening/closing cover 17 is arranged at the open position.

At least one (for example, one) cleaning liquid supply source 53 and at least one (for example, four) liquid supply source 54 are attached to the attachment portion 55 in this embodiment. If a plurality of liquid supply sources 54 are attached, the liquid supply sources 54 may store different kinds of liquid. For example, one liquid supply source 54 may store ink containing a pigment that precipitates in water serving as a solution (for example, white ink containing a white pigment). The other liquid supply sources 54 may each store ink not containing a pigment or less containing a pigment (for example, color ink of cyan, magenta, or yellow).

Figure 5:
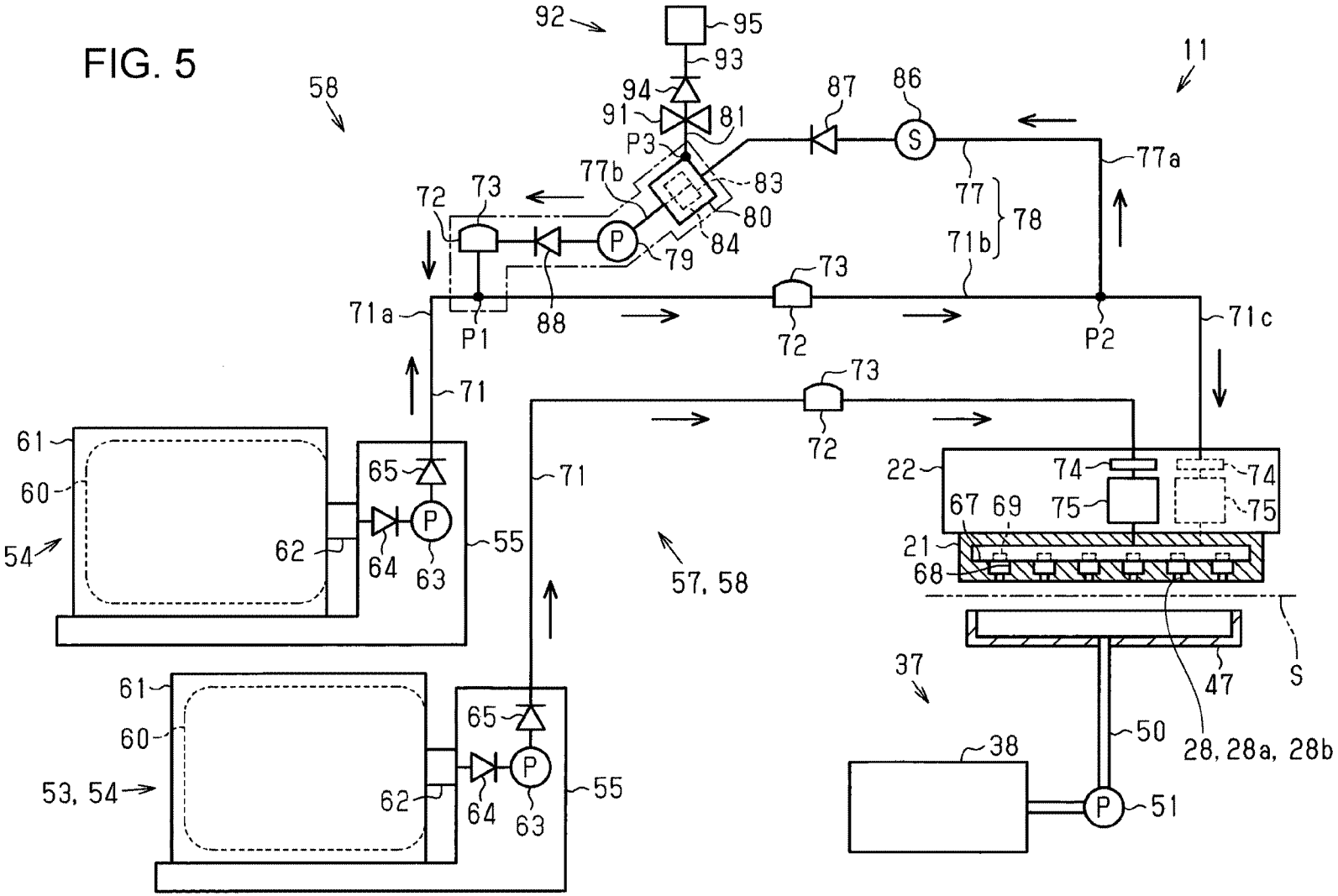
FIG. 5 is a schematic view of a cleaning liquid supply mechanism and a liquid supply mechanism included in the liquid ejecting apparatus in FIG. 1.

As shown in FIG. 5, the liquid ejecting apparatus 11 includes a cleaning liquid supply mechanism 57 that supplies the cleaning liquid from the cleaning liquid supply source 53 to the liquid ejecting head 21, and a liquid supply mechanism 58 that supplies the liquid from the liquid supply source 54 to the liquid ejecting head 21. The liquid supply mechanism 58 is provided by a number corresponding to the number of liquid supply sources 54 attachable to the attachment portion 55, or by a number in accordance with the kinds of liquid to be supplied to the liquid ejecting head 21 (for example, the colors of ink). The liquid ejecting apparatus 11 in this embodiment includes one cleaning liquid supply mechanism 57 and four liquid supply mechanisms 58. The liquid supply mechanism 58 and the cleaning liquid supply mechanism 57 may have the same configuration.

The cleaning liquid supply source 53 and the liquid supply source 54 have the same configuration. The cleaning liquid supply source 53 and the liquid supply source 54 each include a bag 60 that stores the cleaning liquid or the liquid, a case 61 that houses the bag 60, and an outlet portion 62 that leads the cleaning liquid or the liquid stored in the bag 60 to the outside of the case 61. The attachment portion 55 includes a supply pump 63 that supplies, with a pressure, the cleaning liquid stored in the cleaning liquid supply source 53 or the liquid stored in the liquid supply source 54 toward the liquid ejecting head 21.

The supply pump 63 is, for example, a diaphragm pump. An upstream one-way valve 64 is provided upstream of the supply pump 63. A downstream one-way valve 65 is provided downstream of the supply pump 63. The supply pump 63 may be, for example, a tube pump, or a gas supply pump that supplies the cleaning liquid or the liquid by supplying a pressurized gas into the case 61 and squeezing the bag 60. If the supply pump 63 is a tube pump or a gas supply pump, the upstream one-way valve 64 and the downstream one-way valve 65 may not be provided.

The liquid ejecting head 21 includes a common liquid chamber 67 that temporarily stores the liquid or the cleaning liquid, and a plurality of cavities 68 provided to individually correspond to the plurality of nozzles 28. The liquid ejecting head 21 includes a plurality of actuators 69 provided to individually correspond to the respective cavities 68 that store the liquid. The cleaning liquid or the liquid is ejected from the nozzles 28 by driving of the actuators 69.

An embodiment of the cleaning liquid supply mechanism 57 is described next.

As shown in FIG. 5, the cleaning liquid supply mechanism 57 includes a supply channel 71 provided so that the cleaning liquid can be supplied from the cleaning liquid supply source 53 to the cleaning liquid nozzle 28*a*. The supply channel 71 includes the common liquid chamber 67 and the cavities 68 for supplying the cleaning liquid to the cleaning liquid nozzles 28*a*. That is, the cleaning liquid supply mechanism 57 in this embodiment includes the cleaning liquid head unit 24*a* (see FIG. 2) and the attachment portion 55 to which the cleaning liquid supply source 53 is attached. In the cleaning operation of cleaning the suction cap 47, the cleaning liquid supply mechanism 57 can supply the cleaning liquid to the suction cap 47.

Note that the left/right direction in the sheet of FIG. 5 corresponds to the vertical direction (gravity direction), and the lower side in the vertical direction corresponds to the right side in the sheet.

If a reservoir 72 that temporarily stores the cleaning liquid is provided at an intermediate position in the supply channel 71, the pressure of the cleaning liquid to be supplied to the liquid ejecting head 21 is stabilized. The reservoir 72 may be an open tank the inside of which is open to the atmosphere. Alternatively, if the reservoir 72 is a closed reservoir having wall surfaces partly formed of a flexibly displaceable film 73, gas is not mixed to the cleaning liquid.

A first filter 74 that filters the cleaning liquid may be provided upstream of the common liquid chamber 67. The first filter 74 has collection performance that can collect abnormal substances which cannot pass through the liquid ejecting head 21. If the liquid ejecting apparatus 11 includes the holder 22, the holder 22 may hold the first filter 74.

If a pressure regulating mechanism 75 that regulates the pressure of the cleaning liquid which is supplied with a pressure is provided upstream of the common liquid chamber 67, the pressure of the cleaning liquid to be supplied to the cleaning liquid nozzles 28*a* is stabilized. The holder 22 may hold the pressure regulating mechanism 75.

An embodiment of the liquid supply mechanism 58 is described next.

If the liquid supply mechanism 58 is one that supplies liquid containing a precipitable component such as white ink, the liquid supply mechanism 58 may be provided with a return channel 77 having both ends connected to the supply channel 71.

Both the ends of the return channel 77 include a first end that is connected to a first position P1 of the supply channel 71, and a second end that is opposite to the first end and that is connected to a second position P2 of the supply channel 71. The second position P2 is closer to the nozzles 28 than the first position P1. That is, the second end is connected to the second position P2 that is closer to the nozzles 28 than the first position P1.

The supply channel 71 includes an upstream channel 71*a* extending from the liquid supply source 54 to the first position P1, an intermediate channel 71*b* extending from the first position P1 to the second position P2, and a downstream channel 71*c* having a liquid channel extending from the second position P2 to the liquid ejecting head 21 and liquid channels to the nozzles 28 of the liquid ejecting head 21.

The supply channel 71 and the return channel 77 constitute a circulation channel 78. The reservoir 72 may be provided in the intermediate channel 71*b* that is located between the first position P1 and the second position P2 of the supply channel 71 to which the return channel 77 is connected, and that constitutes the circulation channel 78. The direction in which fluid flows in the supply channel 71 and the return channel 77 is indicated by arrows in FIG. 5. The supply pump 63 is arranged in the upstream channel 71*a* that is closer to the liquid supply source 54 than the first position P1 of the supply channel 71, and supplies the liquid from the liquid supply source 54 toward the liquid ejecting head 21.

The liquid ejecting apparatus 11 includes a circulation pump 79 that can cause the fluid in the circulation channel 78 to flow, a filter unit 80 that constitutes a portion of the return channel 77 and that is replaceable, and a communication channel 81 that is connected to the return channel 77 in a manner that allows the return channel 77 to communicate with the outside.

The circulation pump 79 is, for example, a tube pump. The tube pump presses a tube forming a channel and sends the fluid with a pressure when rotationally driven in one direction. The tube pump releases the pressure on the tube and allows the fluid to flow therethrough when rotationally driven in the opposite direction. The direction in which the circulation pump 79 sends the liquid with a pressure in the circulation channel 78 (the direction indicated by arrows in FIG. 5) is a flowing direction. That is, the circulation pump 79 causes the fluid in the circulation channel 78 to flow in the flowing direction. The circulation pump 79 causes the fluid to circulate with a pressure that does not break the menisci formed at the nozzles 28.

The circulation pump 79 may be another type of pump such as a diaphragm pump. The liquid ejecting apparatus 11 drives the circulation pump 79 when not performing printing to circulate the liquid in the circulation channel 78 and hence to stir the liquid, thereby preventing or addressing precipitation of a pigment or the like.

The filter unit 80 includes a second filter 83 that collects abnormal substances, and an upstream filter chamber 84 that stores the liquid on the primary side before passing through the second filter 83. The communication channel 81 may be connected to the upstream filter chamber 84. The gas collected by the second filter 83 is accumulated in the upstream filter chamber 84. Hence, if the communication channel 81 is connected to the upstream filter chamber 84, the collected gas is discharged to the outside through the communication channel 81.

If the second filter 83 serves as an upstream filter, the first filter 74 arranged in the downstream channel 71*c* extending from the second position P2 of the supply channel 71 toward the nozzles 28 serves as a downstream filter. The first filter 74 serving as the downstream filter may have lower performance of collecting abnormal substances than the performance of the second filter 83 serving as the upstream filter.

The circulation pump 79 is arranged between a connection position P3 to which the communication channel 81 is connected in the return channel 77, and the first position P1. The connection position P3 is located between the first end and the second end of the return channel 77. In this embodiment, the return channel 77 has a branch channel 77*a* extending from the connection position P3 to the second position P2. A region provided with the branch channel 77*a* is referred to as "branch region." The return channel 77 has a joint channel 77*b* extending from the connection position P3 to the first position P1. A region provided with the joint channel 77*b* (approximate region surrounded by two-dot chain lines in FIG. 1) is referred to as "joint region."

In the branch region, a pressure sensor 86 may be provided. The pressure sensor 86 can detect the pressure in the return channel 77 that constitutes the circulation channel 78. The liquid ejecting apparatus 11 may include at least one one-way valve (in this embodiment, two valves of a first one-way valve 87 and a second one-way valve 88) that is provided in the circulation channel 78, that allows a flow of the fluid in the flowing direction in the circulation channel 78, and that restricts a flow of the fluid in a direction opposite to the flowing direction. For example, the first one-way valve 87 may be provided in the branch region at a position between the pressure sensor 86 and the filter unit 80. The first one-way valve 87 allows a flow of the fluid from the second position P2 to the filter unit 80, and restricts a flow of the fluid in the opposite direction.

The second one-way valve 88 may be provided in the joint region at a position between the circulation pump 79 and the first position P1. The second one-way valve 88 allows a flow of the fluid from the circulation pump 79 to the first position P1, and restricts a flow of the fluid in the opposite direction. In the joint region, the reservoir 72 may be also provided between the second one-way valve 88 and the first position P1.

An on-off valve 91 is provided in the communication channel 81. The on-off valve 91 causes the communication channel 81 to be open when a gas discharge unit 92 is attached, and causes the communication channel 81 to be closed when the gas discharge unit 92 is detached. If the gas discharge unit 92 is attached, the communication channel 81 communicates with a gas discharge channel 93 included in the gas discharge unit 92.

The gas discharge unit 92 includes the gas discharge channel 93 for discharging gas to the outside, an inflow restrictor 94 configured to restrict mixing of fluid into the communication channel 81 from the outside, and a gas-liquid separator 95 that separates gas and liquid from each other. The inflow restrictor 94 is, for example, a one-way valve that allows an outflow of fluid from the inside to the outside of the communication channel 81, and restricts an inflow of gas (air) from the outside to the communication channel 81 and a backflow of fluid from the inside of the gas discharge channel 93 to the filter unit 80. The gas-liquid separator 95 is provided downstream of the inflow restrictor 94, allows discharge of gas from the gas discharge channel 93, and restricts discharge of liquid from the gas discharge channel 93.

Figure 6:
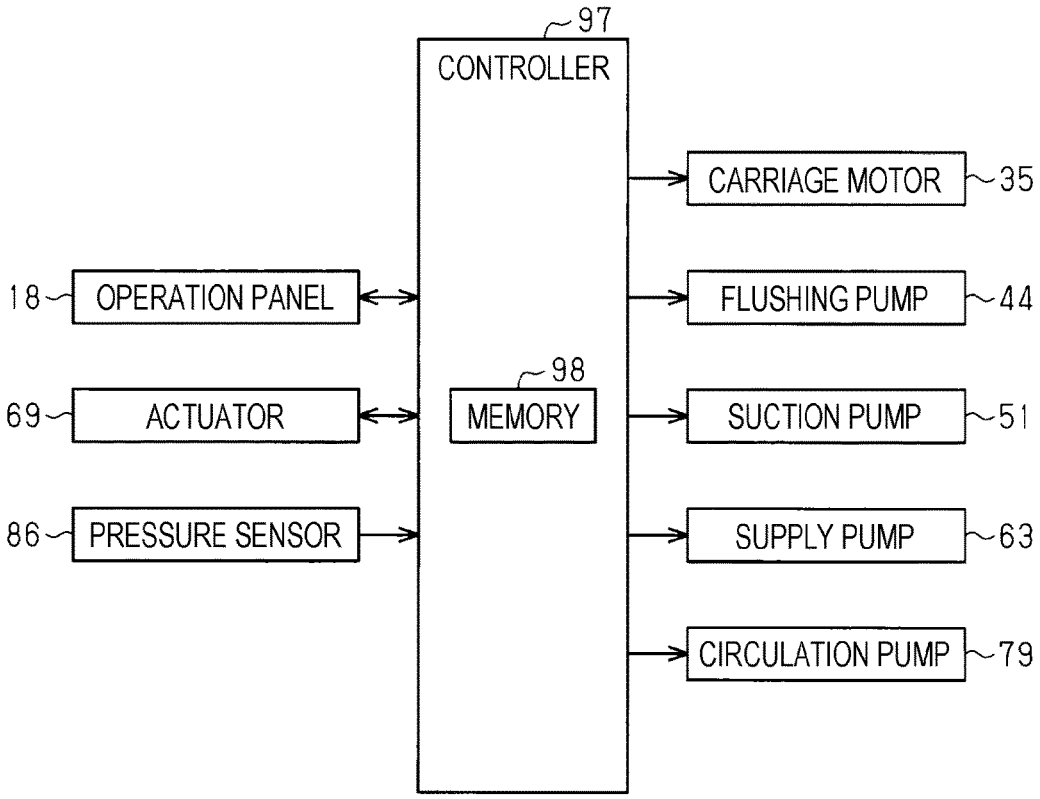
FIG. 6 is a block diagram showing the electric configuration of the liquid ejecting apparatus in FIG. 1.

As shown in FIG. 6, the liquid ejecting apparatus 11 includes a controller 97 that controls components including the operation panel 18, the carriage motor 35, the flushing pump 44, the suction pump 51, the supply pump 63, the actuators 69, and the circulation pump 79. The controller 97 includes a memory 98 that stores a program used for control on the components. The controller 97 executes various processing by executing the program stored in the memory 98. The controller 97 is electrically coupled to the pressure sensor 86.

The controller 97 executes processing of presuming the level of clogging of the second filter 83 at a predetermined timing. For example, the pressure value detected by the pressure sensor 86 while the circulation pump 79 is not driven is used as a stop pressure value, and the pressure value detected by the pressure sensor 86 while the circulation pump 79 is driven is used as a driving pressure value. The controller 97 causes the memory 98 to store the stop pressure value and the driving pressure value. When the difference between the stop pressure value and the driving pressure value is larger than a predetermined threshold, the controller 97 presumes that the second filter 83 is clogged at a level at which replacement is required. At this time, the controller 97 functions as a presuming unit that presumes the level of clogging of the second filter 83 based on the driving state of the circulation pump 79 and the pressure value detected by the pressure sensor 86.

The threshold used for the presumption may be previously calculated through experiment or simulation and stored in the memory 98 included in the controller 97; or may be input by a user through the operation panel 18 or the like. If the controller 97 presumes that the second filter 83 is clogged at the level at which replacement is required, the user is notified of the presumption through the operation panel 18 or the like, and the filter unit 80 is replaced at a proper timing.

An embodiment of the pressure regulating mechanism 75 is described next.

Figure 7:
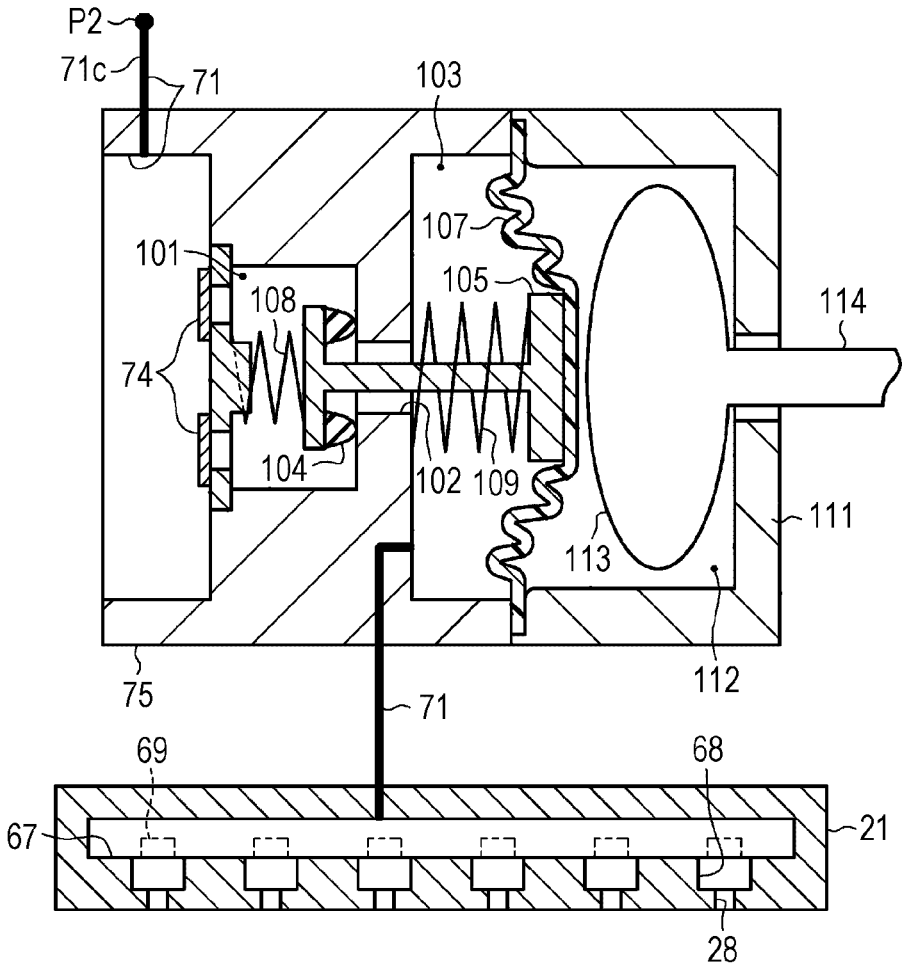
FIG. 7 is a cross-sectional view of a pressure regulating mechanism included in the liquid ejecting apparatus in FIG. 1.

As shown in FIG. 7, the pressure regulating mechanism 75 includes a supply chamber 101 provided at an intermediate position of the supply channel 71, a pressure chamber 103 configured to communicate with the supply chamber 101 through a communication hole 102, a valve body 104 configured to open/close the communication hole 102, and a pressure receiving member 105 whose proximal end side is housed in the supply chamber 101 and whose distal end side is housed in the pressure chamber 103. The supply chamber 101, the communication hole 102, and the pressure chamber 103 constitute a portion of the supply channel 71 that supplies the fluid (cleaning liquid and liquid) to the nozzles 28.

Note that the up/down direction in the sheet of FIG. 7 corresponds to the vertical direction (gravity direction), and the lower side in the vertical direction corresponds to the lower side in the sheet.

The valve body 104 is formed of, for example, a ring-shaped elastic body attached to surround the proximal end portion of the pressure receiving member 105 located in the supply chamber 101. A first filter 74 may be provided at, for example, an inlet of the supply chamber 101. A rod-shaped portion extending from a thin-plate-shaped pressure receiving portion provided on the distal end side of the pressure receiving member 105 to the supply chamber 101 may be divided at an intermediate position, and a rod-shaped portion located on the supply chamber 101 side may be integrated with the valve body 104.

Wall surfaces of the pressure chamber 103 are partly formed of a flexible film 107 that is flexibly displaceable. The pressure regulating mechanism 75 also includes a first urging member 108 that is housed in the supply chamber 101, and a second urging member 109 that is housed in the pressure chamber 103. The first urging member 108 urges the valve body 104 in a direction in which the communication hole 102 is closed via the pressure receiving member 105.

The pressure receiving member 105 is displaced when being pressed by the flexible film 107 that is flexibly displaceable in a direction in which the capacity of the pressure chamber 103 is decreased. Also, the flexible film 107 is flexibly displaced in the direction in which the capacity of the pressure chamber 103 is decreased, when the internal pressure of the pressure chamber 103 is decreased due to discharge of fluid from the nozzles 28. If the pressure (internal pressure) applied to the surface on the inner side, which is on the pressure chamber 103 side, of the flexible film 107 is lower than the pressure (external pressure) applied to the surface on the outer side, which is opposite to the pressure chamber 103, of the flexible film 107, and if the difference between the pressure applied to the surface on the inner side and the pressure applied to the surface on the outer side is a setting value (for example, 1 kPa) or larger, the pressure receiving member 105 is displaced, and the valve body 104 is changed to an open valve state from a closed valve state.

The setting value is a value determined based on the urging forces of the first urging member 108 and the second urging member 109, the force required for displacing the flexible film 107, the pressing force (sealing load) required for closing the communication hole 102 with the valve body 104, and the pressure in the supply chamber 101 and the pressure in the pressure chamber 103 that act on the supply chamber 101 side of the pressure receiving member 105 and on the surface of the valve body 104. That is, the setting value is larger as the urging forces of the first urging member 108 and the second urging member 109 are larger. The urging forces of the first urging member 108 and the second urging member 109 are set to, for example, −1 kPa if the pressure in the pressure chamber 103 is a negative-pressure state in a range in which menisci can be formed at gas-liquid interfaces of the nozzles 28 (for example, if the pressure applied to the surface on the outside of the flexible film 107 is the atmospheric pressure, −1 kPa).

When the communication hole 102 is opened and the fluid flows from the supply chamber 101 into the pressure chamber 103, the internal pressure of the pressure chamber 103 increases. Then, if the internal pressure of the pressure chamber 103 becomes the above-described setting value, the valve body 104 closes the communication hole 102. Even when the fluid is supplied to the supply chamber 101 with a pressure and when the fluid is discharged from the nozzles 28, the pressure from the pressure chamber 103 to the cavities 68 (back pressure of the nozzles 28) is maintained substantially at the setting value.

In this embodiment, the pressure regulating mechanism 75 is arranged in the downstream channel 71*c* extending from the second position P2 of the supply channel 71 to the liquid ejecting head 21. The valve body 104 configured to switch the supply channel 71 between the communication state and the non-communication state is provided, and if the pressure in the region located downstream of the valve body 104 is lower than the setting value that is lower than the pressure in the external space, the valve body 104 autonomously switches the supply channel 71 (communication hole 102) from the communication state to the non-communication state. Hence, the pressure regulating mechanism 75 is classified into a differential pressure valve (among differential pressure valves, in particular, pressure reducing valve).

The pressure regulating mechanism 75 may additionally include a valve opening mechanism 111 that forcedly opens the communication hole 102 and supplies the liquid to the liquid ejecting head 21. The valve opening mechanism 111 includes, for example, a pressure applying bag 113 that is housed in a housing chamber 112 separated from the pressure chamber 103 by the flexible film 107, and a pressure applying channel 114 that causes gas to flow into the pressure applying bag 113. The pressure applying bag 113 is inflated with the gas flowing thereinto via the pressure applying channel 114, the inflated pressure applying bag 113 flexibly displaces the flexible film 107 in a direction in which the capacity of the pressure chamber 103 is decreased, and hence the communication hole 102 is forcedly opened. Since the valve opening mechanism 111 forcedly opens the communication hole 102, the supply channel 71 (communication hole 102) can be forcedly switched from the non-communication state to the communication state.

An embodiment of the filter unit 80 is described next.

Figure 8:
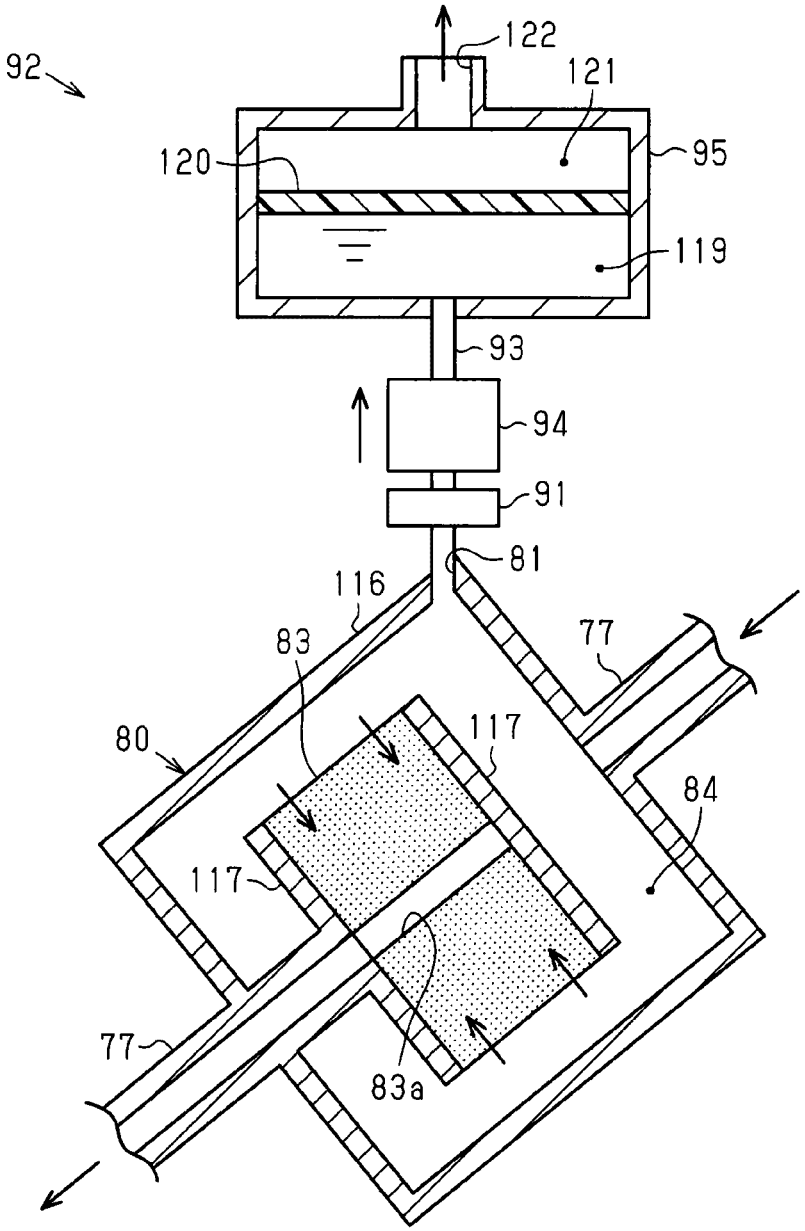
FIG. 8 is a cross-sectional view of a filter unit and an inflow restrictor included in the liquid ejecting apparatus in FIG. 1.

As shown in FIG. 8, the filter unit 80 includes a cylindrical case 116. The second filter 83 is cylindrical, and is arranged in the case 116 coaxially with the case 116. The return channel 77 is connected to circular bottom and upper surfaces of the cylindrical case 116. The upstream filter chamber 84 is formed between the case 116 and the second filter 83 to surround the second filter 83, and hence constitutes a portion of the return channel 77.

Note that the up/down direction in the sheet of FIG. 8 corresponds to the vertical direction (gravity direction), and the lower side in the vertical direction corresponds to the lower side in the sheet.

The second filter 83 has a hole 83*a* defined by a cylindrical inner peripheral surface of the second filter 83. A bottom surface portion and an upper surface portion of the second filter 83 are closed with disk-shaped support plates 117. The upper end of the hole 83*a* is closed with the support plate 117 on the upper surface side, and the lower end side of the hole 83*a* penetrates through the support plate 117 on the bottom surface side. The space in the hole 83*a* is located on the secondary side of the second filter 83, and constitutes the joint region of the return channel 77.

The filter unit 80 is desirably tilted such that the primary side (upstream side) is higher than the secondary side (downstream side). The communication channel 81 is desirably connected to an upper end portion in the vertical direction of the upstream filter chamber 84. Accordingly, the gas which has entered the upstream filter chamber 84 stays in a corner portion at the highest position in the upstream filter chamber 84. Thus, gas more likely enters the communication channel 81 than liquid.

When the fluid enters the filter unit 80 from the branch region on the upstream side in the return channel 77, the fluid is temporarily stored in the upstream filter chamber 84, then enters the second filter 83 through the outer peripheral surface of the second filter 83, and reaches the hole 83*a*. At this time, abnormal substances containing air bubbles are collected by the second filter 83. The air bubbles collected by the second filter 83 stay in the upper portion of the upstream filter chamber 84, and flow to the outside of the channel through the communication channel 81 and the gas discharge channel 93. The liquid from which abnormal substances have been filtered out by the second filter 83 moves to the joint region on the downstream side of the filter unit 80 through the hole 83*a*. The direction in which the fluid flows in the configuration in FIG. 8 is indicated by arrows.

An embodiment of the gas-liquid separator 95 is described next.

As shown in FIG. 8, the gas-liquid separator 95 includes a degassing chamber 119 that temporarily stores the liquid at the terminal of the gas discharge channel 93, a gas discharge chamber 121 separated from the degassing chamber 119 by a degassing film 120, and a gas discharge channel 122 that allows the gas discharge chamber 121 to communicate with the outside. The degassing film 120 has characteristics of allowing gas to pass therethrough, but inhibiting liquid from passing therethrough. The degassing film 120 may employ, for example, a film formed by subjecting polytetrafluoroethylene (PTFE) to special drawing and making multiple fine pores of about 0.2 micrometers in the film. When the liquid containing the gas flows into the degassing chamber 119, only the gas passes through the degassing film 120, enters the gas discharge chamber 121, and is discharged to the outside through the gas discharge channel 122. Thus, the air bubbles and dissolved gas mixed into the liquid stored in the degassing chamber 119 are eliminated while the liquid is not discharged from the gas discharge channel 93.

A maintenance method for the liquid ejecting apparatus 11 is described next.

Figure 9:
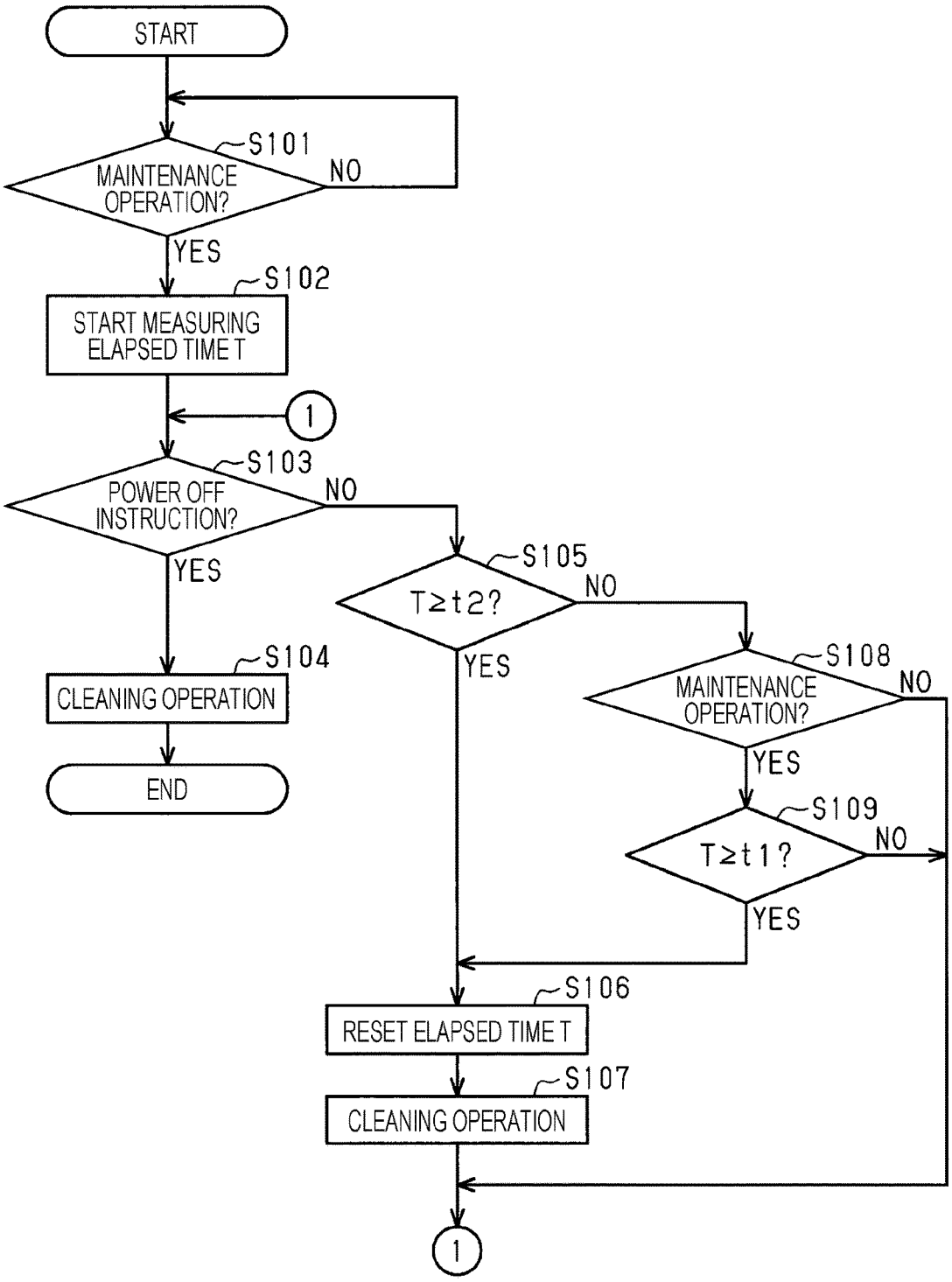
FIG. 9 is a flowchart showing a maintenance processing routine.

A maintenance processing routine shown in FIG. 9 is executed at a timing at which the power of the liquid ejecting apparatus 11 is turned ON.

As shown in FIG. 9, in step S101, the controller 97 determines whether the maintenance operation has been executed or not. If the maintenance operation has not been executed (step S101: NO), the controller 97 waits until the maintenance operation is executed. If the maintenance operation has been executed (step S101: YES), in step S102, the controller 97 starts measuring elapsed time T.

In step S103, the controller 97 determines whether power-OFF has been instructed. If power-OFF has been instructed (step S103: YES), in step S104, the controller 97 executes the cleaning operation and ends the maintenance processing routine.

In step S103, if power-OFF has not been instructed (step S103: NO), in step S105, the controller 97 determines whether the elapsed time T has exceeded a second setting time t2. If the elapsed time T has exceeded the second setting time t2 (step S105: YES), in step S106, the controller 97 resets the elapsed time T. In step S107, the controller 97 executes the cleaning operation, and moves the processing to step S103.

In step S105, if the elapsed time T has not exceeded the second setting time t2 (step S105: NO), in step S108, the controller 97 determines whether the maintenance operation has been executed. If the maintenance operation has not been executed (step S108: NO), the controller 97 moves the processing to step S103.

In step S108, if the maintenance operation has been executed (step S108: YES), in step S109, the controller 97 determines whether the elapsed time T has exceeded the first setting time t1. If the elapsed time T has not exceeded the first setting time t1 (step S109: NO), the controller 97 moves the processing to step S103. If the elapsed time T has exceeded the first setting time t1 in step S108, the controller 97 moves the processing to step S106.

Advantageous effects of the liquid ejecting apparatus 11 are described next.

Figure 10:
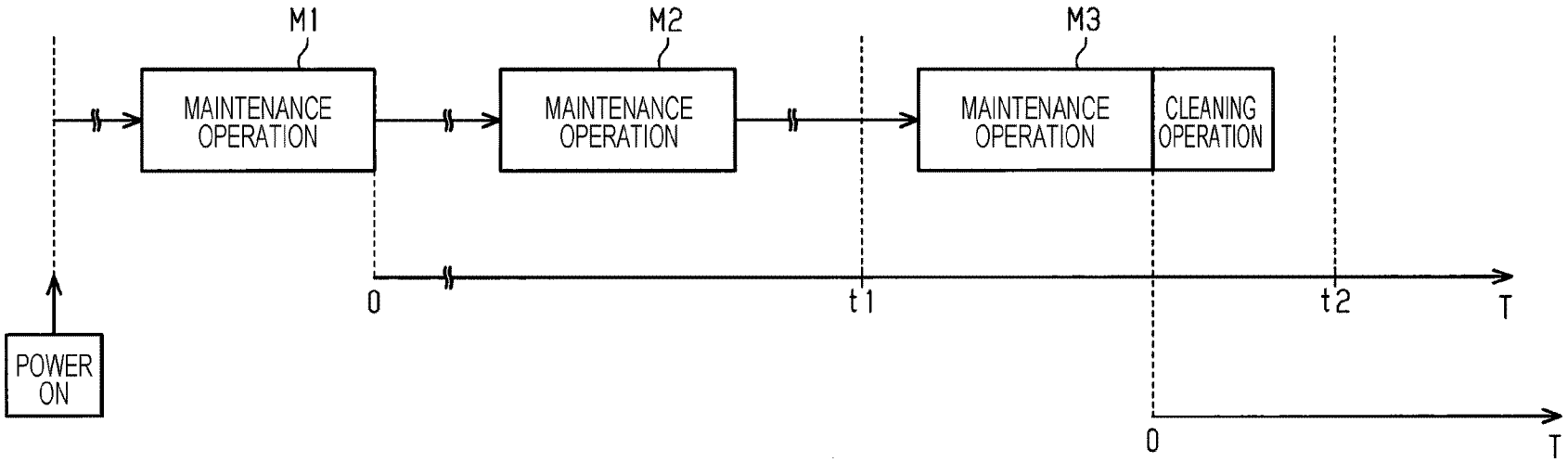
FIG. 10 is a timing chart showing timings at which a maintenance operation and an ejection operation are executed.

As shown in FIG. 10, when the power of the liquid ejecting apparatus 11 is turned ON and a first maintenance operation M1 is executed, the controller 97 starts measuring the elapsed time T.

In the maintenance operation, the suction pump 51 is driven and sucks the liquid while the suction cap 47 forms the closed space containing the liquid nozzles 28*b*. In one-time maintenance operation, the plurality of liquid head units 24*b* are sequentially capped one by one, the suction pump 51 is driven, and the liquid is sucked from all the liquid nozzles 28*b*. When the maintenance operation is performed, the supply pump 63 may be driven and the liquid of the liquid supply source 54 may be supplied with a pressure. With the maintenance operation, the liquid containing abnormal substances such as air bubbles are discharged from the liquid nozzles 28*b*, and at the same time the supply channel 71 is filled with the liquid newly supplied from the liquid supply source 54.

The suction cap 47 receives the liquid discharged from the liquid ejecting head 21 in the maintenance operation for the liquid ejecting head 21. The suction pump 51 sucks the liquid received by the suction cap 47, and causes the liquid to be discharged to the waste liquid container 38 through the suction tube 50. At this time, the liquid may remain in the suction cap 47 and the suction tube 50. The remaining liquid may be deteriorated (for example, increased in viscosity or solidified) as time elapses and clog the suction tube 50.

In this embodiment, a time after which the adhering liquid is no longer washed out with the cleaning liquid is set as the second setting time t2 (for example, 24 hours). The first setting time t1 is a time shorter than the second setting time t2 (for example, 23.5 hours). The difference between the first setting time t1 and the second setting time t2 is desirably longer than the time required for the maintenance operation. The difference between the first setting time t1 and the second setting time t2 is desirably a time longer than the time required for performing printing on one ejection medium S, or the time required for one-time print processing.

The elapsed time T from when a former maintenance operation M1 has been executed to when a later maintenance operation M2 is executed is shorter than the first setting time t1, the controller 97 executes the maintenance operation M2. That is, the controller 97 executes the maintenance operation M2, but does not execute the cleaning operation. When the maintenance operation M2 without the cleaning operation executed, the controller 97 does not reset the elapsed time T and continues measurement.

The elapsed time T from when the former maintenance operation M1 has been executed to when a later maintenance operation M3 is executed is equal to or longer than the first setting time t1 and shorter than the second setting time t2, the controller 97 executes the maintenance operation M3 and the cleaning operation. That is, the cleaning operation is executed after the later maintenance operation M3 is executed, subsequently to the maintenance operation M3.

If the cleaning operation is executed subsequently to the maintenance operation M3, the controller 97 resets the elapsed time T at a timing at which the maintenance operation M3 has been ended. When the maintenance operation M3 with the cleaning operation is executed, the controller 97 measures the time which has elapsed since the maintenance operation M3 has been ended, as the elapsed time T.

In the cleaning operation, the suction pump 51 sucks the cleaning liquid while the suction cap 47 forms the space containing the cleaning liquid nozzles 28*a*. Thus, the cleaning liquid is supplied from the cleaning liquid nozzles 28*a* included in the liquid ejecting head 21 to the suction cap 47. The suction pump 51 introduces the cleaning liquid to the suction tube 50, and cleans the suction cap 47 and the suction tube 50.

When the cleaning operation is performed, the supply pump 63 may be driven and the cleaning liquid of the cleaning liquid supply source 53 may be supplied with a pressure. With the cleaning operation, the cleaning liquid is discharged from the cleaning liquid nozzles 28*a*, and at the same time the supply channel 71 is filled with the cleaning liquid newly supplied from the cleaning liquid supply source 53.

The controller 97 drives the suction pump 51 while the cleaning liquid head unit 24*a* is capped, and then drives the suction pump 51 while the suction cap 47 is positioned at a retraction position. Thus, the cleaning liquid is discharged from the suction cap 47 and the suction tube 50, and is stored in the waste liquid container 38.

Figure 11:
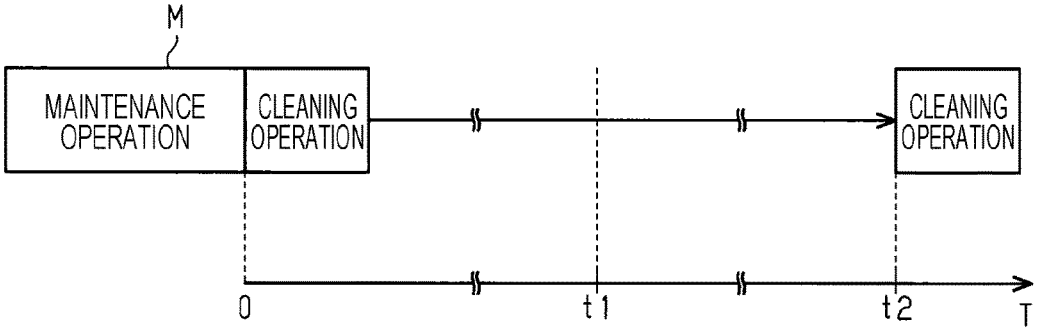
FIG. 11 is a timing chart showing a case where an elapsed time exceeds a second setting time.

As shown in FIG. 11, when the elapsed time T reaches the second setting time t2, the controller 97 executes the cleaning operation. That is, the cleaning operation is executed when the second setting time t2 has elapsed if the later maintenance operation is not executed until the second setting time t2 elapses since the former maintenance operation M is executed.

Figure 12:
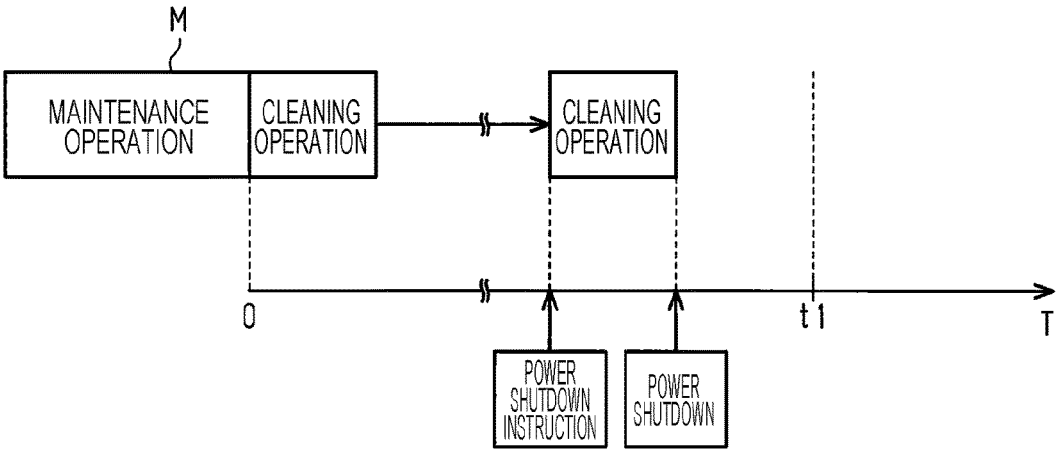
FIG. 12 is a timing chart showing a case where power shutdown is instructed.

As shown in FIG. 12, if shutdown of the power of the liquid ejecting apparatus 11 is instructed, the controller 97 executes the cleaning operation, and then shuts down the power of the liquid ejecting apparatus 11. If the power is to be shut down, the cleaning operation is executed regardless of the elapsed time T which has elapsed since the maintenance operation M has been executed.

With the above-described embodiment, the following advantageous effects can be obtained.

(1) The liquid discharged from the liquid ejecting head 21 and received by the suction cap 47 due to the maintenance operation may be increased in viscosity or solidified as the time elapses, and may not be cleaned out with the cleaning operation. However, frequent execution of the cleaning operation is troublesome. In this case, if the later maintenance operation is executed after the first setting time t1 elapses since the former maintenance operation has been executed and before the second setting time t2 elapses, the cleaning operation is executed subsequently to the later maintenance operation. The maintenance mechanism 37 is cleaned while cleaning with the cleaning operation is available, and the possibility that maintenance performance is degraded due to an increase in viscosity of the liquid or the like can be reduced. Thus, the maintenance mechanism 37 can be efficiently cleaned while the maintenance performance for the liquid ejecting head 21 by the maintenance mechanism 37 is ensured.

(2) If the time from when the former maintenance operation has been executed to when the later maintenance operation is executed is equal to or longer than the second setting time t2, the cleaning operation is executed when the second setting time t2 has elapsed since the former maintenance operation has been executed. Thus, the frequency with which the cleaning operation is executed is decreased, and the maintenance mechanism 37 can be efficiently cleaned.

(3) If the power is to be shut down, the cleaning operation is executed regardless of the elapsed time T which has elapsed since the maintenance operation has been executed. Thus, the possibility that the maintenance mechanism 37 is left standing without cleaning can be reduced.

(4) The cleaning liquid is supplied to the suction cap 47 by using the cleaning liquid nozzles 28*a* included in the liquid ejecting head 21. Thus, the cleaning operation can be performed with a simple configuration as compared with a case where a mechanism for supplying the cleaning liquid is additionally provided.

(5) The cleaning liquid is sucked from the cleaning liquid nozzles 28*a* by using the suction pump 51 that sucks the liquid received by the suction cap 47 and causes the liquid to be discharged. Thus, the cleaning operation can be performed with a simple configuration as compared with a case where a mechanism for supplying the cleaning liquid is additionally provided.

The above-described embodiments may be modified like modifications described below. Any of the embodiments may be desirably combined with any of the modifications. Configurations included in the modifications may be desirably combined with one another.

For example, an ejection medium S such as paper or cloth may have fuzz such as frayed fibers due to rubbing or the like. The liquid ejecting apparatus 11 may include a fuzz catcher that collects the fuzz. For example, the fuzz catcher has a collecting surface that collects the fuzz, and may be provided at the holder 22 such that the collection surface faces the ejection medium S. The fuzz catcher moves with the movement of the holder 22 such that the collection surface faces the ejection medium S, and collects the fuzz. The absorbing member 49 may wipe the collection surface of the fuzz catcher.

The cleaning liquid supply mechanism 57 may supply the cleaning liquid to the absorbing member 49. The absorbing member 49 may wipe the nozzle formation surface 27 and the collection surface of the fuzz catcher while impregnated with the cleaning liquid. Since the collection surface of the fuzz catcher is wet with the cleaning liquid, the collection surface can more easily collect the fuzz.

The cleaning liquid supply mechanism 57 may supply the cleaning liquid to the flushing box 42 which is an example of a receiving portion that receives the liquid which is discharged from the liquid ejecting head 21 during flushing, which is an example of the maintenance operation. The liquid ejecting apparatus 11 may allow the flushing unit 39 to be cleaned. In the cleaning operation of the flushing unit 39, the cleaning liquid is ejected to the flushing box 42, and the cleaning liquid is discharged to the waste liquid container 38 by using the flushing pump 44. Thus, the possibility that the liquid remaining in the flushing box 42 and the flushing tube 43 is increased in viscosity or solidified can be reduced. The cleaning operation of the flushing unit 39 is desirably performed at an interval shorter than the second setting time t2.

The flushing unit 39 may not include the flushing pump 44. The liquid and the cleaning liquid received by the flushing box 42 may be collected in the waste liquid container 38 due to gravity.

The cleaning liquid supply mechanism 57 may supply the cleaning liquid to the wiper 48 and clean the wiper 48.

The cleaning liquid supply mechanism 57 may supply the cleaning liquid to the moisturizing cap 46. The liquid ejecting apparatus 11 may use the cleaning liquid as moisturizing liquid for moisturizing the space formed by capping with the moisturizing cap 46.

The liquid ejecting apparatus 11 may allow the moisturizing cap 46 to be cleaned. The moisturizing cap 46 may include an atmosphere communication hole. The moisturizing cap 46 allows the space formed by capping to communicate with the outside through the atmosphere communication hole. Thus the moisturizing cap 46 can decrease a variation in pressure in the space. The moisturizing cap 46 may be cleaned by discharging the cleaning liquid, which has been supplied to the moisturizing cap 46, from the atmosphere communication hole.

The cleaning liquid supply mechanism 57 may drive the supply pump 63 while communicating with the supply channel 71 by using the valve opening mechanism 111, and supply the cleaning liquid with a pressure. The cleaning liquid supply mechanism 57 may not include the pressure regulating mechanism 75.

The liquid ejecting head 21 may not eject the cleaning liquid. In the liquid ejecting apparatus 11, the actuators 69 corresponding to the cleaning liquid nozzles 28*a* may not be electrically coupled. The liquid ejecting head 21 may not include the actuators 69 corresponding to the cleaning liquid nozzles 28*a*.

The cleaning operation may be performed while the suction cap 47 is positioned at the retraction position. The cleaning liquid supply mechanism 57 may eject the cleaning liquid from the cleaning liquid nozzles 28*a* and supply the cleaning liquid to the suction cap 47. The cleaning liquid supply mechanism 57 may eject drops of the cleaning liquid with a pressure from the cleaning liquid nozzles 28*a* and supply the cleaning liquid to the suction cap 47. The cleaning operation may drive the suction pump 51 while the suction cap 47 does not provide capping, and may send the cleaning liquid supplied to the suction cap 47 to the waste liquid container 38.

The cleaning liquid supply mechanism 57 may supply the cleaning liquid by a plurality of methods with different amounts of cleaning liquid which can be supplied per unit time. For example, regarding the amounts of cleaning liquid which can be supplied per unit time, the amount of cleaning liquid supplied with a pressure by the supply pump 63 is larger than the amount of cleaning liquid ejected from the cleaning liquid nozzles 28*a*; and the amount of cleaning liquid sucked and discharged by the suction pump 51 is larger than the amount of cleaning liquid supplied with a pressure by the supply pump 63. The method of supplying the cleaning liquid may be changed in accordance with the elapsed time T. Thus, the consumption of cleaning liquid can be decreased. For example, if the maintenance operation is executed at the elapsed time T shorter than the first setting time t1, the cleaning liquid may be ejected from the cleaning liquid nozzles 28*a* to the suction cap 47. The cleaning liquid can decrease the speed at which the liquid adhering to the suction cap 47 is degraded (increased in viscosity or solidified). If the maintenance operation is executed at the elapsed time T which is equal to or longer than the first setting time t1 and is shorter than the second setting time t2, the cleaning liquid may be supplied with a pressure. If the elapsed time T exceeds the second setting time t2, the cleaning liquid may be sucked and discharged.

In the cleaning operation, the suction pump 51 is driven while the cleaning liquid head unit 24*a* is capped, and then the suction pump 51 may not be driven while the suction cap 47 is positioned at the retraction position. That is, in the cleaning operation, the cleaning liquid may remain in the suction cap 47 and the suction tube 50. The cleaning liquid in the suction cap 47 and the suction tube 50 may dissolve the liquid modified after a certain time has elapsed, and then may be discharged to the waste liquid container 38.

In the cleaning operation, the suction pump 51 may not be driven. The cleaning liquid supplied to the suction cap 47 may be collected in the waste liquid container 38 due to gravity.

The cleaning liquid supply mechanism 57 may not include the cleaning liquid head unit 24*a*. For example, with the cleaning liquid supply mechanism 57, the downstream end of the supply channel 71 may be connected to the suction cap 47, and the cleaning liquid may be supplied. For example, the cleaning liquid may be supplied from the downstream end of the supply channel 71 fixed to the holder 22, to the suction cap 47 positioned at the retraction position. For example, a supply port through which the cleaning liquid is supplied to the liquid ejecting head 21 may be provided.

The cleaning liquid supply mechanism 57 and the liquid supply mechanism 58 each may not include the supply pump 63, the upstream one-way valve 64, and the downstream one-way valve 65. The liquid ejecting apparatus 11 may supply the cleaning liquid from the cleaning liquid supply source 53 to the suction cap 47, for example, by a head. The liquid ejecting apparatus 11 may supply the liquid from the liquid supply source 54 to the liquid ejecting head 21, for example, by a head.

The cleaning operation may not be executed even if the power of the liquid ejecting apparatus 11 is shut down. For example, if the power is to be shut down after the maintenance operation and the cleaning operation are executed and before the next maintenance operation is executed, the power may be shut down without the cleaning operation executed. If the elapsed time T is shorter than the threshold time and have a time until the second setting time t2 elapses, the power may be shut down without the cleaning operation executed.

The cleaning operation may not be executed when the second setting time t2 has elapsed even if the later maintenance operation is not executed until the second setting time t2 elapses since the former maintenance operation has been executed. For example, if another operation such as printing is executed when the second setting time t2 has elapsed, the controller 97 may execute the cleaning operation after the operation in execution is ended. If printing is performed beyond the second setting time t2, the cleaning liquid may be ejected from the cleaning liquid nozzles 28*a* to the suction cap 47 during printing, and the cleaning operation may be executed after printing. The liquid ejecting head 21 desirably ejects the cleaning liquid while the pressure from the suction pump 51 to the suction tube 50 is released.

The ejection medium S is not limited to a sheet of paper, and may be a plastic film, a thin plate material, or a fabric which is used for a textile printing machine or the like.

The liquid to be ejected from the liquid ejecting head 21 is not limited to ink. For example, the liquid may be a liquid-like body in which particles made of a functional material are dispersed or mixed. For example, recording may be performed by ejecting a liquid-like body containing a material, such as an electrode material or a colorant (pixel material), which is used for manufacturing a liquid crystal display, an electroluminescence (EL) display, or a surface emitting display, in a dispersed manner or a dissolved manner.

Hereinafter, technical ideas and advantageous effects thereof recognized from the above-described embodiments and modifications are described below.

Idea 1

A liquid ejecting apparatus includes a liquid ejecting head having a nozzle that ejects liquid to an ejection medium; a maintenance mechanism having a receiving portion that receives the liquid which is discharged from the liquid ejecting head in a maintenance operation for the liquid ejecting head; and a cleaning liquid supply mechanism configured to supply cleaning liquid to the receiving portion in a cleaning operation of cleaning the receiving portion. If a time from when the maintenance operation of former one has been executed to when the maintenance operation of later one is executed is equal to or longer than a first setting time and shorter than a second setting time, after the maintenance operation of the later one is executed, the cleaning operation is executed subsequently to the maintenance operation of the later one.

The liquid discharged from the liquid ejecting head and received by the receiving portion due to the maintenance operation may be increased in viscosity or solidified as the time elapses, and may not be cleaned out with the cleaning operation. However, frequent execution of the cleaning operation is troublesome. In this case, with this configuration, if the later maintenance operation is to be executed after the first setting time elapses since the former maintenance operation has been executed and before the second setting time elapses, the cleaning operation is executed subsequently to the later maintenance operation. The maintenance mechanism is cleaned while cleaning with the cleaning operation is available, and the possibility that maintenance performance is degraded due to an increase in viscosity of the liquid or the like can be reduced. Thus, the maintenance mechanism can be efficiently cleaned while the maintenance performance for the liquid ejecting head by the maintenance mechanism is ensured.

Idea 2

In the liquid ejecting apparatus according to Idea 1, if the maintenance operation of the later one is not executed until the second setting time elapses since the maintenance operation of the former one has been executed, the cleaning operation is executed when the second setting time has elapsed.

With this configuration, if the time from when the former maintenance operation has been executed to when the later maintenance operation is executed is equal to or longer than the second setting time, the cleaning operation is executed when the second setting time has elapsed since the former maintenance operation has been executed. Thus, the frequency with which the cleaning operation is executed is decreased, and the maintenance mechanism can be efficiently cleaned.

Idea 3

In the liquid ejecting apparatus according to Idea 1 or Idea 2, if power is to be shut down, the cleaning operation is executed regardless of an elapsed time which has elapsed since the maintenance operation has been executed.

With this configuration, if the power is to be shut down, the cleaning operation is executed regardless of the elapsed time which has elapsed since the maintenance operation has been executed. Thus, the possibility that the maintenance mechanism is left standing without cleaning can be reduced.

Idea 4

In the liquid ejecting apparatus according to any one of Idea 1 to Idea 3, the liquid ejecting head has a cleaning liquid nozzle, and the cleaning liquid is supplied to the receiving portion from the cleaning liquid nozzle.

With this configuration, the cleaning liquid is supplied to the receiving portion by using the cleaning liquid nozzle included in the liquid ejecting head. Thus, the cleaning operation can be performed with a simple configuration as compared with a case where a mechanism for supplying the cleaning liquid is additionally provided.

Idea 5

In the liquid ejecting apparatus according to Idea 4, the maintenance mechanism has a pump that sucks the liquid received by the receiving portion, and that causes the liquid to be discharged to a waste liquid container through a discharge channel. The receiving portion is a cap that contacts the liquid ejecting head and forms a space containing the nozzle. In the cleaning operation, the pump sucks the cleaning liquid, introduces the cleaning liquid to the discharge channel, and performs cleaning while the cap forms the space containing the cleaning liquid nozzle.

With this configuration, the cleaning liquid is sucked from the cleaning liquid nozzle by using the pump that sucks the liquid received by the receiving portion and causes the liquid to be discharged. Thus, the cleaning operation can be performed with a simple configuration as compared with a case where a mechanism for supplying the cleaning liquid is additionally provided.

Idea 6

A maintenance method for a liquid ejecting apparatus including a liquid ejecting head having a nozzle that ejects liquid to an ejection medium, and a maintenance mechanism having a receiving portion that receives the liquid which is discharged from the liquid ejecting head in a maintenance operation for the liquid ejecting head includes, if a time from when the maintenance operation of former one has been executed to when the maintenance operation of later one is executed is equal to or longer than a first setting time and shorter than a second setting time, executing a cleaning operation of cleaning the receiving portion, subsequently to the maintenance operation of the later one.

With this method, advantageous effects similar to those of the above-described liquid ejecting apparatus can be provided.

The entire disclosure of Japanese Patent Application No. 2017-212824, filed Nov. 2, 2017, is expressly incorporated by reference herein.

What is claimed is:

1. A liquid ejecting apparatus comprising:

a liquid ejecting head having a nozzle that ejects liquid to an ejection medium;

a maintenance mechanism having a receiving portion that receives the liquid which is discharged from the liquid ejecting head in a maintenance operation for the liquid ejecting head;

a cleaning liquid supply mechanism configured to supply cleaning liquid to the receiving portion in a cleaning operation of cleaning the receiving portion; and a controller, wherein, if a time from when the maintenance operation of former one has been executed to when the maintenance operation of later one is executed is equal to or longer than a first setting time and shorter than a second setting time, the controller executes, after the maintenance operation of the later one is executed, the cleaning operation subsequently to the maintenance operation of the later one.

2. The liquid ejecting apparatus according to claim 1, wherein, if the maintenance operation of the later one is not executed until the second setting time elapses since the maintenance operation of the former one has been executed, the cleaning operation is executed when the second setting time has elapsed.

3. The liquid ejecting apparatus according to claim 1, wherein, if power is to be shut down, the cleaning operation is executed regardless of an elapsed time which has elapsed since the maintenance operation has been executed.

4. The liquid ejecting apparatus according to claim 1, wherein the liquid ejecting head has a cleaning liquid nozzle, and the cleaning liquid is supplied to the receiving portion from the cleaning liquid nozzle.

5. The liquid ejecting apparatus according to claim 4, wherein the maintenance mechanism has a pump that sucks the liquid received by the receiving portion, and that causes the liquid to be discharged to a waste liquid container through a discharge channel, wherein the receiving portion is a cap that contacts the liquid ejecting head and forms a space containing the nozzle, and wherein, in the cleaning operation, the pump sucks the cleaning liquid, introduces the cleaning liquid to the discharge channel, and performs cleaning while the cap forms the space containing the cleaning liquid nozzle.

6. A maintenance method for a liquid ejecting apparatus including a liquid ejecting head having a nozzle that ejects liquid to an ejection medium, and a maintenance mechanism having a receiving portion that receives the liquid which is discharged from the liquid ejecting head in a maintenance operation for the liquid ejecting head, the method comprising:

if a time from when the maintenance operation of former one has been executed to when the maintenance operation of later one is executed is equal to or longer than a first setting time and shorter than a second setting time, executing a cleaning operation of cleaning the receiving portion, subsequently to the maintenance operation of the later one.

7. The maintenance method for the liquid ejecting apparatus according to claim 6, wherein, if the maintenance operation of the later one is not executed until the second setting time elapses since the maintenance operation of the former one has been executed, the cleaning operation is executed when the second setting time has elapsed.

8. The maintenance method for the liquid ejecting apparatus according to claim 6, wherein, if power of the liquid ejecting apparatus is shut down, the cleaning operation is executed regardless of an elapsed time which has elapsed since the maintenance operation has been executed.

9. The maintenance method for the liquid ejecting apparatus according to claim 6, wherein the liquid ejecting head has a cleaning liquid nozzle configured to supply the cleaning liquid, wherein the maintenance mechanism has a pump that sucks the liquid received by the receiving portion, and that causes the liquid to be discharged to a waste liquid container through a discharge channel, wherein the receiving portion is a cap that contacts the liquid ejecting head and forms a space containing the nozzle, and wherein the cleaning operation is executed by sucking the cleaning liquid by using the pump while the cap forms a space containing the cleaning liquid nozzle.

* * * * *